US005529178A

United States Patent [19]

Gorlich

[11] Patent Number: 5,529,178

[45] Date of Patent: Jun. 25, 1996

[54] PACKAGE FOR PACKAGING LARGE MEAT PRODUCTS IN A DESIRED GASEOUS ATMOSPHERE

[75] Inventor: Michael P. Gorlich, Hilton Head Island, S.C.

[73] Assignee: World Class Packaging Systems, Inc., Hilton Head Island, S.C.

[21] Appl. No.: 278,416

[22] Filed: Jul. 21, 1994

Related U.S. Application Data

[62] Division of Ser. No. 98,530, Jul. 28, 1993, Pat. No. 5,419, 096.

[51] Int. Cl.[6] ..... B65D 81/24; B65D 51/16

[52] U.S. Cl. ..... 206/213.1; 220/367.1; 220/769; 220/772; 426/118

[58] Field of Search ..... 206/213.1; 220/359, 220/366, 367, 768, 769, 771, 772, 371–372, 912, 913; 426/118, 129, 395, 396, 113

[56] References Cited

U.S. PATENT DOCUMENTS

| | | | |
|---|---|---|---|
| 2,289,037 | 7/1942 | Poglein | 220/771 X |
| 2,368,795 | 2/1945 | Wittenberg | 220/772 X |
| 2,423,975 | 7/1947 | Helm . | |
| 3,278,074 | 10/1966 | Yamazaki | 220/771 X |
| 3,716,180 | 2/1973 | Bemiss et al. . | |
| 3,794,090 | 2/1974 | Commisso . | |
| 4,055,672 | 10/1977 | Hirsch et al. . | |
| 4,261,504 | 4/1981 | Cowan | 220/359 X |
| 4,600,117 | 7/1986 | Tzifkansky et al. | 220/360 X |
| 4,640,838 | 2/1987 | Isakson et al. . | |
| 4,844,263 | 7/1989 | Hadthe | 220/359 X |
| 4,880,951 | 11/1989 | Levinson | 220/771 X |
| 4,909,022 | 3/1990 | Kubis et al. . | |
| 5,065,889 | 11/1991 | Conti | 220/360 X |
| 5,348,752 | 9/1994 | Gorlich | 426/129 |
| 5,377,860 | 1/1995 | Littlejohn et al. . | |

FOREIGN PATENT DOCUMENTS

| | | | |
|---|---|---|---|
| 1810958 | 6/1970 | Germany . | |
| 2335021 | 1/1975 | Germany . | |
| WO91/03407 | 3/1991 | WIPO . | |
| 9301104 | 1/1993 | WIPO | 220/359 |

*Primary Examiner*—Bryon P. Gehman
*Attorney, Agent, or Firm*—Arnold, White & Durkee

[57] ABSTRACT

A package, packaging method, and packaging apparatus for facilitating the packaging of large meat products and exchanging the ambient atmosphere to establish a desired gaseous atmosphere that extends the shelf life of the product. The package includes a pair of preformed relatively rigid plastic domed or cupped members which abut along a sealing surface. The upper and lower package portions include flanges which are adapted to facilitate not only the formation of the package but its subsequent opening. A reciprocatable filling tube maintains the separation between the upper and lower package portions to permit gas exchange and then may be reciprocated downwardly to allow the upper package portion to abut atop the lower package portion for sealing connection.

8 Claims, 6 Drawing Sheets

PACKAGE FOR PACKAGING LARGE MEAT PRODUCTS IN A DESIRED GASEOUS ATMOSPHERE

This is a divisional of application Ser. No. 08/098,530, filed on Jul. 28, 1993, now U.S. Pat. No. 5,419,096.

FIELD OF THE INVENTION

This invention relates to packages for food products which are adapted for gaseous exchange to extend the life of the food product. Particularly, this invention relates to such packages, packaging methods, and packaging apparatus adapted to contain relatively large meat products such as whole chickens, roasts, or other large meat products.

BACKGROUND OF THE INVENTION

Domed meat packages have been used in the past to contain large cuts of meats such as chickens or roasts. However, these packages have suffered from a number of drawbacks.

It is desirable to control the atmosphere within the meat package to delay the aging of the food product and to extend its shelf life in the supermarket. For example, by providing low oxygen environments, the shelf life of the food product can be extended from a few days to as long as two weeks or more perhaps.

In order to make the customer feel comfortable with the food packaging, the customer should be able to view a substantial portion of the food product. In order to maintain a desired atmosphere around the package, a package which is somewhat larger than the food product is required. However, with a large, relatively heavy meat product it is difficult to allow for spacing around the food product and yet maintain the product in an attractive fashion within the container.

Moreover, since the consumer would normally desire that he or she be able to see the food product, the spacing becomes visible to the consumer. The consumer may believe that the package is too large and wasteful. Moreover, if the product is substantially larger than the food product, the food product may move around during transportation and handling, and the package itself may be indented or otherwise damaged.

In the past, deep draw packages may have been used for this type of packaging. However, deep draw packages become difficult to form at large sizes and may experience significant deformation of the packaging material. These packages are particularly susceptible to the formation of thin spots and to the indenting and collapsing of the corner regions.

Thus, the present applicant has appreciated that it would be desirable to form a domed package rather than to use the deep draw plastic forming technique. With the domed package, the product may protrude above the sealing flanges that connect the upper and lower package portions. It is also possible to form the package portions from different materials adapted to particular packaging needs. For example, it may be desirable to form the bottom portion out of foam material and the top out of transparent plastic.

The requirements of a relatively large package made of relatively rigid packaging material seem to be incompatible with the necessity of extra space within the package for conventional gas exchange techniques to extend the shelf life. Thus, most conventional, large food products are simply overwrapped with plastic wrap, and the supermarket endures the additional costs that result from meat loss.

Therefore, it would be highly desirable to provide a relatively rigid domed food package, packaging method, and packaging apparatus which allows relatively large cuts of meat to be efficiently packaged in a desirable gas environment.

DETAILED DESCRIPTION OF THE PREFERRED EMBODIMENT

Figure 1A:
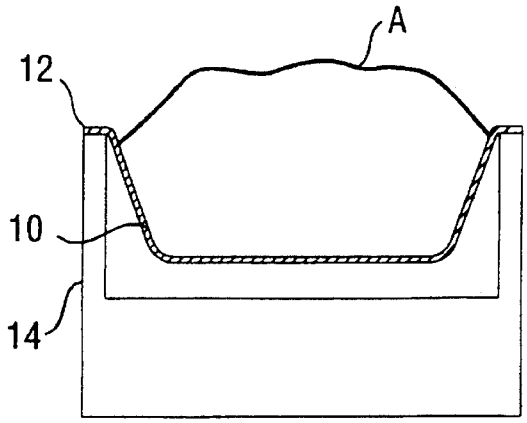
FIG. 1 is a simplified cross-sectional view showing three stages in one embodiment of a packaging process in accordance with the present invention.
Figure 1B:
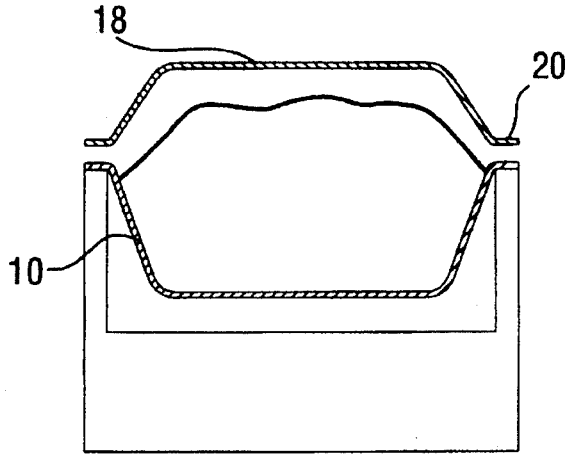
Figure 1C:
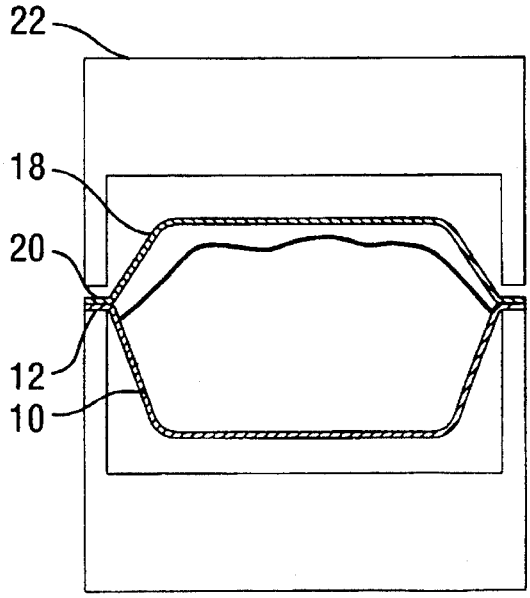

Referring to the drawing wherein like reference characters are used for like parts throughout the several views, a packaging process for packaging a large meat product "A" is shown in FIG. 1 and includes the steps a, b, and c. In step a, the food product "A" is shown contained within a dish-shaped plastic package portion 10 which is supported by a peripheral flange 12 on a member 14.

The package portion 10 may be formed of a variety of conventional materials including any known plastic packaging material. In many instances, it may be desirable to form the lower package portion 10 of molded foamed plastic so that the package portion will be relatively rigid.

Referring to FIG. 1, step b, an upper package portion 18 is shown in spaced relation to the lower package portion 10 over the food product "A". The package portion 18 is domed and includes a peripheral flange 20. Like the package portion 10, the upper package portion 18 may be formed of a variety of conventional plastic materials. However, in many instances, it may be desirable to form the upper package portion 18 out of relatively rigid, molded transparent plastic material. This allows the food product "A" to be viewed within the food package. Advantageously, both the portions 10 and 18 are preformed of relatively rigid, molded plastic material.

As shown in FIG. 1, step c, the upper and lower package portions 18 and 10 may be joined along their peripheral flanges 20 and 12 by an apparatus 22 which presses the flanges 20 of the portion 18 downwardly onto the flanges 12 of the package portion 10. If desired, the apparatus 22 may be a heat seal machine which causes heat sealing of the juxtaposed flange portions thereby connecting the materials.

The advantage of holding the upper domed portions 18 in spaced juxtaposition with the lower portion 10 is that the gaseous environment within the package may be transformed prior to the sealing step c shown in FIG. 1. For example, the air inside the package may be exhausted, and a desired gas may be supplied in its place. The desired gas may be one which is relatively low in oxygen content so that the shelf life of the food product may be extended. For example, the gas may be relatively higher in either carbon dioxide and/or nitrogen than normal atmospheric air in order to prevent or diminish the oxidation processes that shorten the life of the meat product "A".

Figure 2:
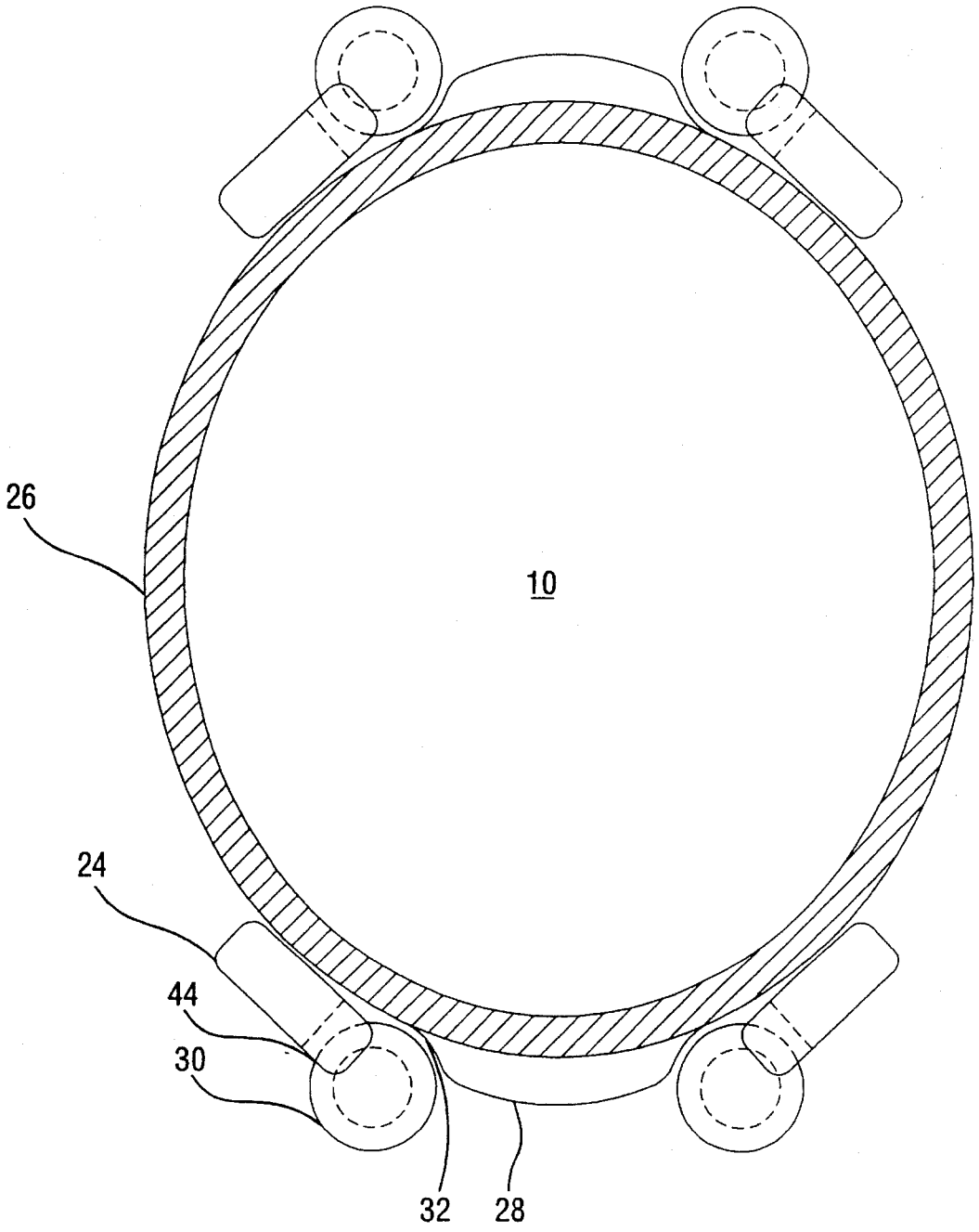
FIG. 2 is a partial, enlarged, top plan view of the package shown in FIG. 1*a;*

As shown in FIG. 2, the lower package portion 10 may be maintained in a desired arrangement by a set of two pairs of opposed guides 24. Each of the guides 24 is arranged in a substantially tangential arrangement to the curved sides of the lower package portion 10 so as to abut with the sealing region 26. The sealing region 26 provides the point of attachment to the upper package portion 18. It can also be seen in FIG. 2 that the lower package portion 10 may include an outwardly extending flange portion 28 on either of two opposed ends of the package 10. While the package 10 shown in FIG. 2 has an oblong configuration, the cross-sectional configuration of the package may assume one of a variety of different shapes.

Figure 3:
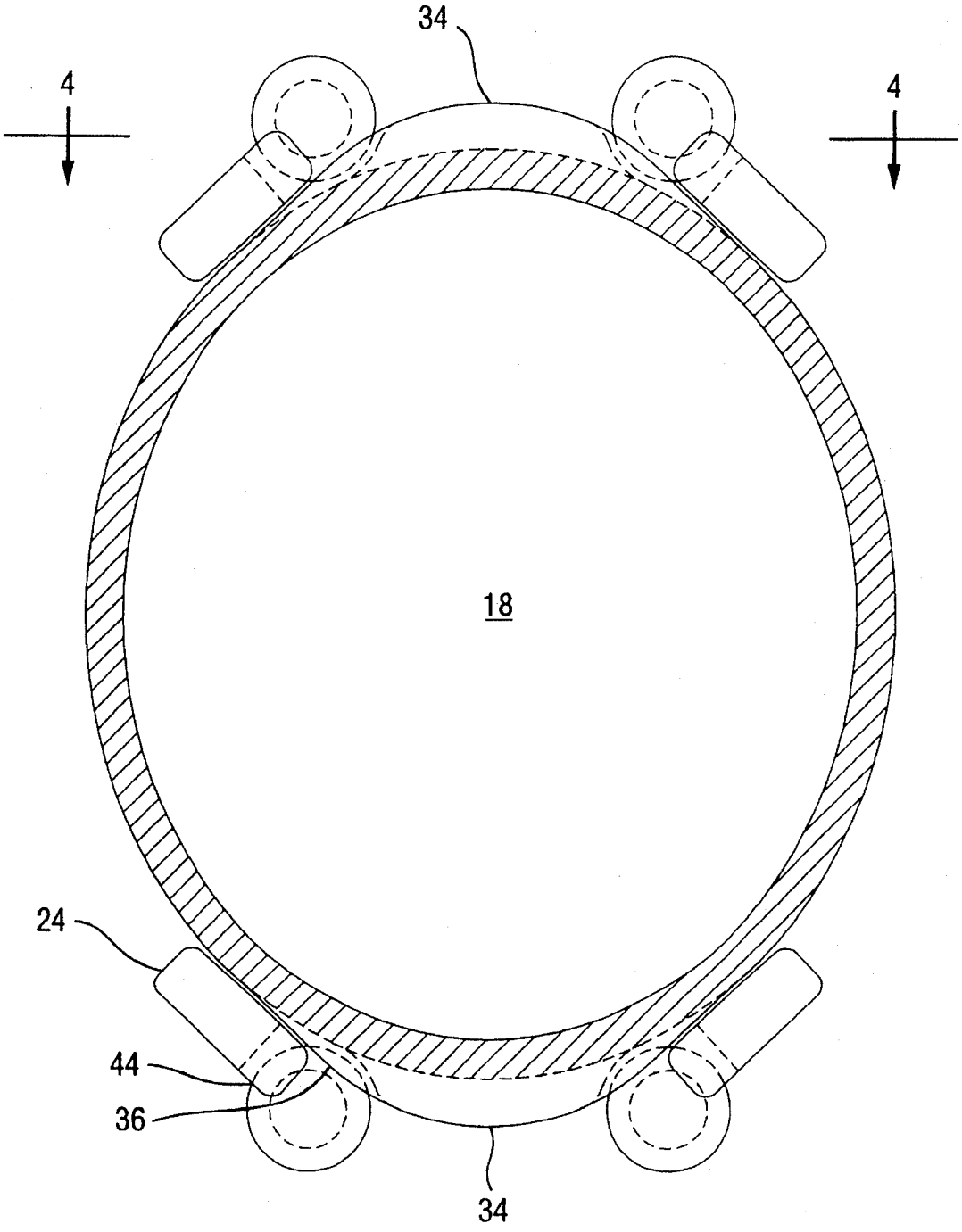
FIG. 3 is a partial, enlarged, top plan view of the package shown in FIG. 1*b;*

FIG. 3 shows the positioning of the upper package portion 18 over the lower package portion 10. The upper package portion 18 includes a pair of opposed bluntly pointed end flanges 34 which interact with and are constrained between each set of guides 24. The outwardly extending flange portions 34 extend over the tubes 30 such that the tubes 30 do not generally guide the positioning of the upper package portion 18 in the horizontal plane. This accomplished substantially by the guides 24. In the regions 36, the flanges 34 extend past the edges 32 of the flanges 28 so that there is a region of overhang of the flange 34 over the lower package portion 10.

Figure 4:
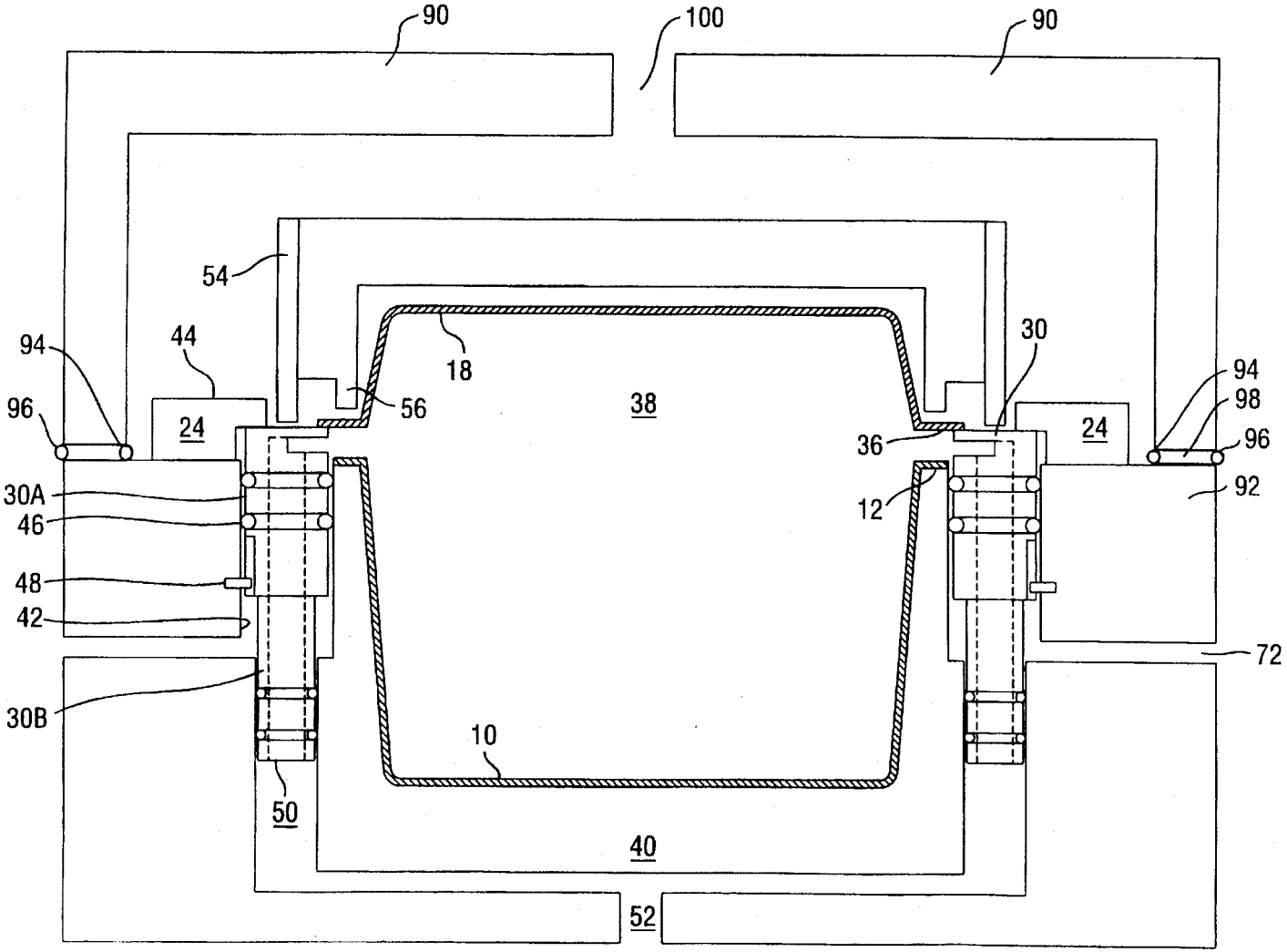
FIG. 4 is an enlarged, cross-sectional view of one embodiment of a packaging apparatus for accomplishing the process steps shown in FIG. 1*b;*

FIG. 4 shows a packaging machine for achieving the package operation shown in FIG. 1*b*. In order to illustrate that a variety of package shapes may be utilized, the package 38 shown in FIG. 4 is of a slightly different shape than the package shown in FIG. 1. In particular, the lower package portion 10 is deeper than the package portion 10 shown in FIG. 1, and the abruptness of both the lower and the upper package portions 18 and 10 is greater in the embodiment shown in FIG. 4.

The lower package portion 10 rests in a conforming tray 40 which conforms to its outside configuration and supports the flange 12. The upper package portion 18 has its flange portion 36 resting atop the filling tube 30.

The filling tube 30 is reciprocal up and down within a slot 42. However, the extent of its upward extension is controlled by the overhanging edge 44 of the adjacent guide 24. Each tube 30 includes an outer cylinder 30*a* and an inner cylinder 30*b*.

The outer cylinder 30*a* includes a set of "O" rings 46 which prevent leakage around the tube 30. A pin 48 is provided to control the extent of downward movement of the tube 30 and to prevent its rotation about its lengthwise axis. Within the center of the tube 30 is a bore 50 which is capable of conveying gas to or from the interior of the package to or from the passageway 52. Thus, gas may pass via the passageway 52 to or from the interior of the package shown in the configuration of FIG. 4.

A pressurized gas supply passageway 72 is connected to a source (not shown) of pressurized gas. When desired, pressurized gas may be communicated via the passageway 72 to act on the lower end of the outer cylinder 30*a*. This causes the tube 30 to move to its upper position shown in FIG. 4.

Juxtaposed over the upper package portion 18 is a pusher bar 54 and a sealing bar 56. The sealing bar 56 may be a conventional heat sealing bar which heat seals the flanges of the upper package portion 18 to those of the lower package portion 10.

The vacuum chamber cover 90 seals to the lower chamber 92 through inner and outer peripheral seals 94 and 96 and the abutment of gasket 98 on the lower chamber 92. A valved passage 100 is provided for pulling a vacuum inside the chamber defined by the cover 90.

Figure 6:
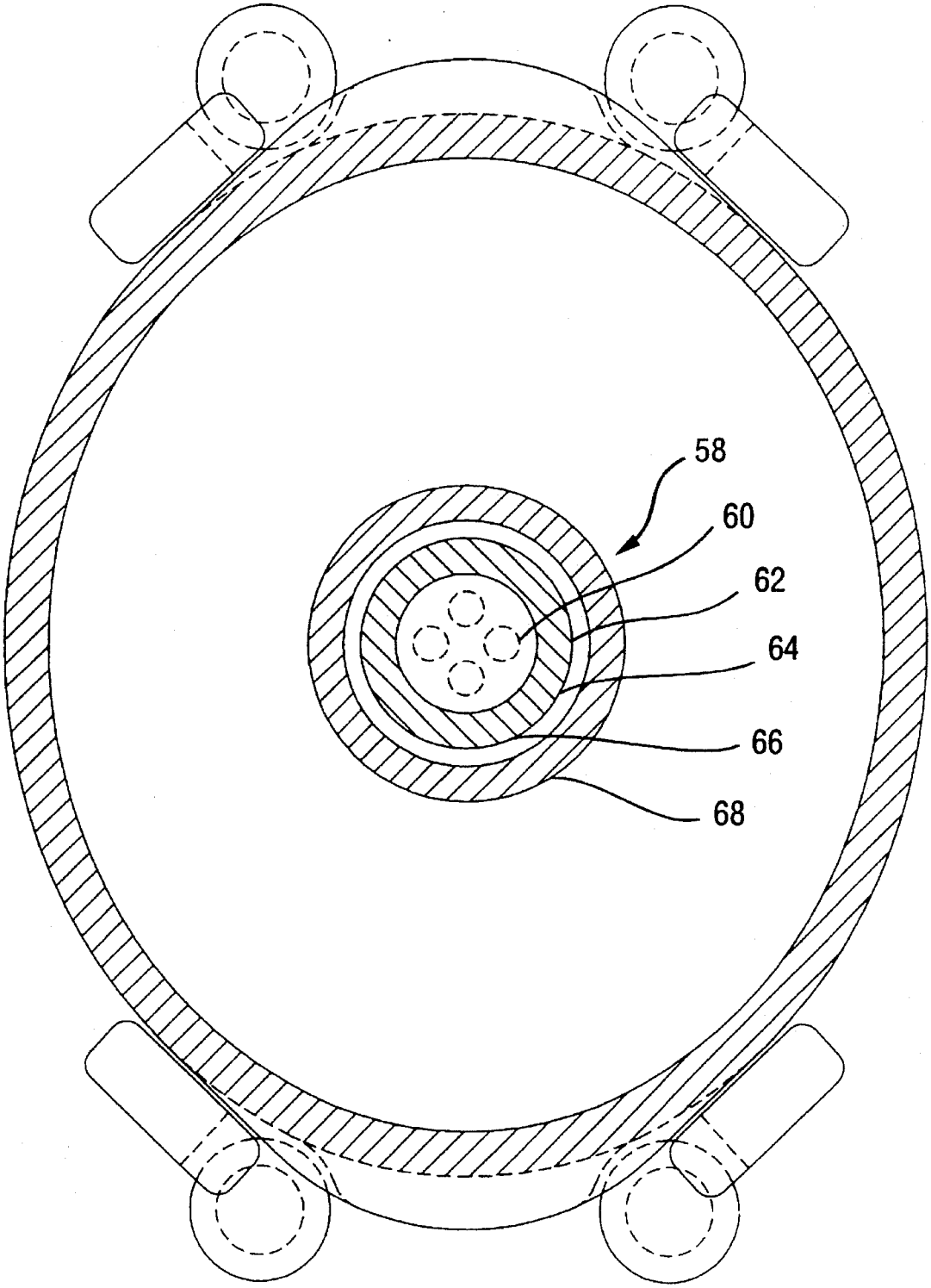
* and FIG. 6 is an enlarged, top plan view of another embodiment of the package shown in the position illustrated in FIG. 1*b*.

FIG. 6 shows an alternate embodiment in which a gas exchange system is provided on the upper package portion 18. The gas exchange portion 58 is constructed generally in accordance with the teaching of applicant's co-pending patent application Ser. No. 08/064,700, filed May 20, 1993, hereby expressly incorporated by reference herein. The portion 58 includes one or more holes 60 formed in the package portion 18. These holes are covered by a first circular plastic film layer 62 which may be permeable to atmospheric air. The layer 62 is sealed to the package portion 18 at 64. Attached over the portion 62 is an upper fluid impermeable plastic film 66 which is sealed at 68 to the upper package portion 18. When desired, the layer 66 may be peeled away to allow gas exchange through the lower layer 62 via the holes 60.

The method and apparatus of the present invention may be implemented in the following fashion. The lower package portion 10, loaded into the conforming tray 40, is supported by its flanges 12. Then a meat product "A", if not already loaded, may be loaded inside the package portion 10. Next, the relatively rigid top or upper portion 18 is aligned over the lower package portion 10 but resting on the top of the filling tubes 30 as shown in FIG. 4.

Initially, the air within the package is exhausted through both the passage 100 and the bore 50 to the passageway 52. Then, with the passage 100 closed, a desired gaseous environment is passed through the passageway 52 and the bore 50 into the package. This gaseous environment may be one which is relatively poor in its concentration of oxygen and relatively higher (with respect to normal ambient atmosphere) with respect to its carbon dioxide and/or nitrogen content. The result of such an environment is to extend the shelf life of a meat product. This is because the presence of oxygen causes the meat product to age and discolor.

Figure 5:
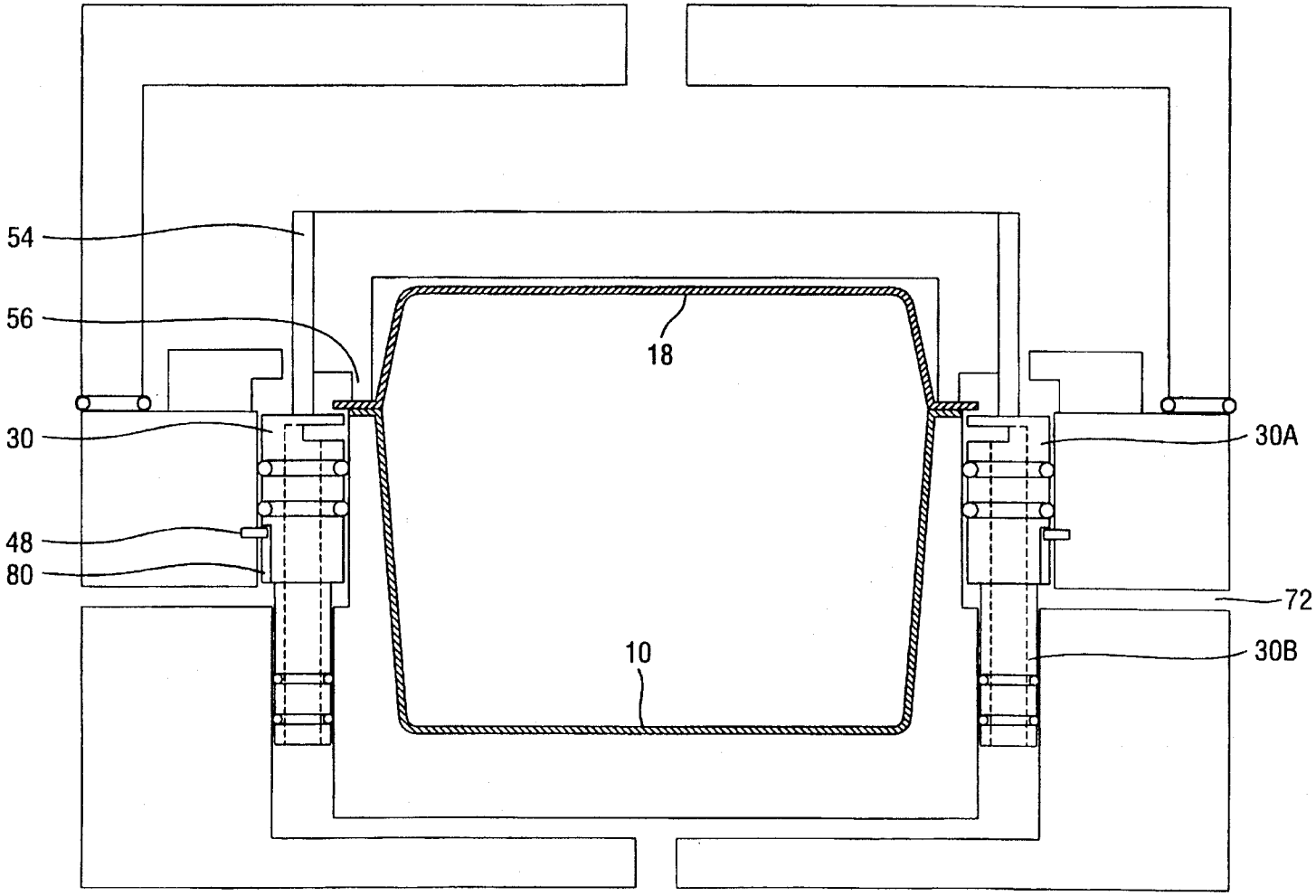
FIG. 5 is an enlarged, cross-sectional view of the packaging apparatus of FIG. 4, shown in position to accomplish the process steps shown in FIG. 1*c.

After the desired environment has been established, the gas filling tubes 30 are pushed downwardly by the pusher bar 54 into their passageways 42 until the pins 48 engage the top of the slots 80. In this position, shown in FIG. 5, the upper package portion 18 is in abutment with the lower package portion 10. At this point, the sealing regions 26 are likewise in abutment. The package is thereafter sealed along the regions 26 of the upper and lower package portions 10 and 18 to provide an air tight seal between the two package portions. This is accomplished through the sealing bar 56 which may, in one advantageous embodiment, cause heat sealing of the components together. The sealing bar 56 reciprocates with the pusher bar 54. However, the pusher bar 54 pushes the tubes 30 below the flanges to insure that, regardless of the package thickness, the tubes 30 do not interfere with the sealing process.

The completed package 38 may be removed by raising the cover 90 with the sealing bar 56 and pusher bar 54. The package 38 may be removed from the conforming carrier 40. This may be accomplished in batch or continuous fashion as desired.

The cycle may be repeated after the gas tubes 30 are reciprocated to their upper position. This is achieved by supplying air pressure to the upper cylinders 30*a*. The air pressure is released through a relief valve (not shown) when the tubes 30 are pushed downwardly by the pusher bar 54.

The positioning of the upper and lower packaging portions 10 and 18 with respect to one another is assured by the provision of the guides 24 and the filling tubes 30 which interact with the special package shape to ensure exact juxtaposed position of the parts relative to one another. Moreover, the flange portions 36 of the upper package portion 18 maintain the separation of the package when they abut with the filling tubes 30.

Firstly, the lower package portion 10 is inserted into the conforming carrier 40, guided by tubes 30 and guides 24. Then, the upper package portion 18 is located on the tubes 30, positioned by the guides 24. Thereafter, the cover 90 is closed and the process may be repeated.

In many applications, particularly those involving red meat, it may be desirable to withdraw the low oxygen atmosphere from the container at the point of sale. Otherwise, the package with its low oxygen environment will cause the meat to have a purplish color. Thus, in the supermarket, the upper fluid impermeable film 66 may be peeled back. This allows ambient atmosphere to enter the package so that the meat will take on a reddish color.

The provision of the overhang 36 of the upper package portion 18 over the lower package portion 10 facilitates the removal of the domed upper package portion 18 in use. Moreover, the concealed location of the overhang 36 diminishes the possibility of accidental opening.

Thus, it is apparent that there has been provided, in accordance with the invention, a package, a method, and a packaging apparatus that satisfies the aims, objects, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such embodiments, alternatives, modifications, and variations that fall within the spirit and broad scope of the appended claims.

I claim:

1. A package for facilitating gas exchange, comprising:

an upper substantially rigid domed package portion;

said domed package portion including an upper flange extending away from the remainder of said domed package portion;

a lower substantially rigid, dished package portion having a lower flange extending outwardly from the remainder of said dished package portion;

each of said package portions including sealing regions for sealing connection to the other package portion; and an aperture located in one of said package portions for permitting selective gas escape from said package, said aperture being covered by a gas permeable plastic sheet secured to said package at a first location, said gas permeable plastic sheet being further covered by a removable gas impermeable plastic sheet secured to said package at a location different from said first location.

2. The package of claim 1, including a pair of upper flanges and a pair of lower flanges wherein said upper and lower flanges are aligned and overlap along their outermost extensions.

3. The package of claim 2, wherein said upper flanges substantially overlap said lower flanges, each of said lower flanges having two sides extending outwardly from said package portion and connected by said outermost extension of said each lower flange, said upper flanges overlapping said lower flanges at each of said sides.

4. The package of claim 2, wherein said upper flanges overlap less than all of said lower flanges, such that the overlapping region of each upper flange is protected from accidental engagement by the portion of the adjacent lower flange which is not overlapped by said upper flange.

5. The package of claim 4, wherein said upper and lower flanges are substantially aligned at their points of outermost extension, said upper flanges overlapping said lower flanges to either side of the points of outermost extension of said upper flanges.

6. A package for facilitating gas exchange, comprising:

an upper substantially rigid domed package portion;

said domed package portion including a pair of opposed upper flanges extending away from the remainder of said domed package portion;

a lower substantially rigid, dished package portion having a pair of opposed lower flanges extending outwardly from the remainder of said dished package portion; and said upper flanges arranged to extend outwardly past said lower flanges, said lower flanges each including an outermost extension connected by two sides to said dished package portion, said upper flanges substantially overlapping said lower flanges on both of said sides.

7. The package of claim 6 wherein said upper flanges overlap less than all of said lower flanges, such that the overlapping region of each upper flange is protected from accidental engagement by the portion of the adjacent lower flange which is not overlapped by said upper flange.

8. The package of claim 7 wherein said upper and lower flanges are substantially aligned at their points of outermost extension, said upper flanges overlapping said lower flanges to either side of the points of outermost extension of said upper flanges.

* * * * *